US006332845B1

(12) United States Patent
Priestley

(10) Patent No.: US 6,332,845 B1
(45) Date of Patent: Dec. 25, 2001

(54) GOLF SWING TRAINING AID

(76) Inventor: Richard Andrew Priestley, 28 Sabot Street, Jamboree Heights, Queensland (AU), 4074

( * ) Notice: Subject to any disclaimer, the term of this patent is extended or adjusted under 35 U.S.C. 154(b) by 0 days.

(21) Appl. No.: 09/424,745

(22) PCT Filed: Apr. 30, 1998

(86) PCT No.: PCT/AU98/00308

§ 371 Date: Nov. 29, 1999

§ 102(e) Date: Nov. 29, 1999

(87) PCT Pub. No.: WO98/53888

PCT Pub. Date: Dec. 3, 1998

(30) Foreign Application Priority Data

May 30, 1997 (AU) ..... PO7084

(51) Int. Cl.[7] ..... A63B 69/36
(52) U.S. Cl. ..... 473/207; 473/215; 473/409
(58) Field of Search ..... 473/207, 215, 473/270–277

(56) References Cited

U.S. PATENT DOCUMENTS 4,045,033 * 8/1977 Schuman ..... 473/215
4,088,326 * 5/1978 Bifulco ..... 473/209
5,016,885 * 5/1991 Quigley ..... 473/209

FOREIGN PATENT DOCUMENTS

2284556 A * 6/1995 (GB) .

* cited by examiner

*Primary Examiner*—Mark S. Graham
*Assistant Examiner*—Raeann Gorden
(74) *Attorney, Agent, or Firm*—Reed Smith Hazel & Thomas LLP

(57) ABSTRACT

A golf swing training aid (10), to be fitted between a player's knees, has an elongate, telescopic body (11), with foam pads (16, 18) on respetive cross-heads (17, 19) at each end of the body (11). A flexible strap (20) releasably secures one cross-head (17) to one of the player's knees and the other cross-head (17) rests against the other knee. The knees are held stable on the backswing and first half of the downswing of the club, but the aid (10) releases the knees as the swing is completed.

10 Claims, 11 Drawing Sheets

GOLF SWING TRAINING AID

BACKGROUND OF THE INVENTION (1) Field of the Invention

THIS INVENTION relates to a golf swing training aid.

The invention is particularly suitable for, but not limited to, a swing training aid for sports such as golf, baseball, softball, tennis and the like.

Throughout the specification, the term "golf" shall be used to include the other sports hereinbefore described.

(2) Prior Art

Most golf training aids, designed to aid or improve a player's swing, are directed to the movement of the upper body and/or the arms. However, little attention has been given to the stability of the lower body during the different phases of the swing.

Ideally, the lower body (ie., hips down) will remain substantially immobile during the back swing and on the forward swing until the club/bat moves to, or past, the centre line of the body.

It has been known to use a bucket tied between the knees as an aid to stabilise the lower body.

However, such an arrangement holds the knees apart during the final phase of the forward portion of the swing and results in an unnatural swing.

Examples which have been proposed to control the movement of the player's legs during the swing are disclosed in GB 2,284,556 (BUCKINGHAM); U.S. Pat. Nos. 5,016,885 (QUIGLEY); 4,706,957 (JACKSON) and 4,088,326 (BIFULCO).

The latter three documents disclose aids where the player's knees (or lower legs) are bound together at a fixed spacing. In GB 2,284,556 (BUCKINGHAM), the golf training device is fitted between both knees below the knee joints, with side supports, secured by releasable straps, where a plastic swivel bar with a centre pivot interconnects the side supports and allows some controlled movement between the legs. While some movement between the knees can occur during the swing, both knees must be fastened to the device, generating an unnatural movement.

SUMMARY OF THE PRESENT INVENTION

It is an object of the present invention to provide a training aid which holds the knees substantially stabilised for approximately the first half of the swing, while allowing the knees to move as the swing is completed.

It is a preferred object of the present invention to provide such an aid where the knees will be released when the arms are approximately aligned with the centre line of the body.

It is a further preferred object of the present invention to provide such a training aid which can be releasably secured at, or adjacent, one of the player's knees, and be releasably engageable with the other of his/her knees.

It is a still further preferred object of the present invention to provide such an aid which can accommodate a range of spacings between the player's knees, eg., to accommodate players of different height and/or stances.

Other preferred objects of the present invention will become apparent from the following description.

In a broad aspect, the present invention resides in a swing training aid for golf or other sports, including:

an elongate body having respective first and second end portions engageable with a player's legs at, or adjacent, the player's knees; and a releasable securement means at or adjacent one of the end portions to releasably secure the body to the adjacent one of the player's legs; so arranged that:

on a back swing and during at least a portion of a forward swing, the player's knees are maintained in a substantially fixed or stable relationship, the other end of the body being releasable from the player's legs to allow the player's knees to move during the completion of the forward swing.

Preferably, the body is variable in length and may have components which are telescopically interconnected. A releasable lock, clip, bolt, pawl or like means may be provided to enable the length of the body to be selectively set.

In one preferred embodiment, a pair of box-like members are telescopically inter-engaged; while in the second preferred embodiment, a pair of knee-engagement cups or yoke-like members are provided at the ends of a pair of telescopically inter-engaged tubes.

Preferably, the securement means is a strap, rope, thong or the like releasably securable about one of the player's legs.

Preferably, the adjacent end portion has a pad or tapered nose which provides a pivotal axis for the body when the other end is released from the player's other leg.

Preferably, the other end portion has an inclined face, preferably curved in plan view, so arranged that during the completion portion of the swing, the player's adjacent knee will tend to force that end portion of the body downwardly to release the aid from that knee.

Preferably, the body will be released from the player's other knee, when the arms, on the forward swing, are just in advance or pass, the centre of gravity of the aid, ie., approximately in alignment with the centre line of the player's body.

Preferably, for a right-handed golfer or batter, the aid will be secured to the left leg at, or above, the left knee, and the aid will releasably engage at or above the right knee of the player's right leg. For left-handed players, the arrangement will be reversed.

BRIEF DESCRIPTION OF THE DRAWINGS

To enable the invention to be fully understood, a preferred embodiment will now be described with reference to the accompanying drawings in which.

DETAILED DESCRIPTION OF THE PREFERRED EMBODIMENTS

Figure 1:
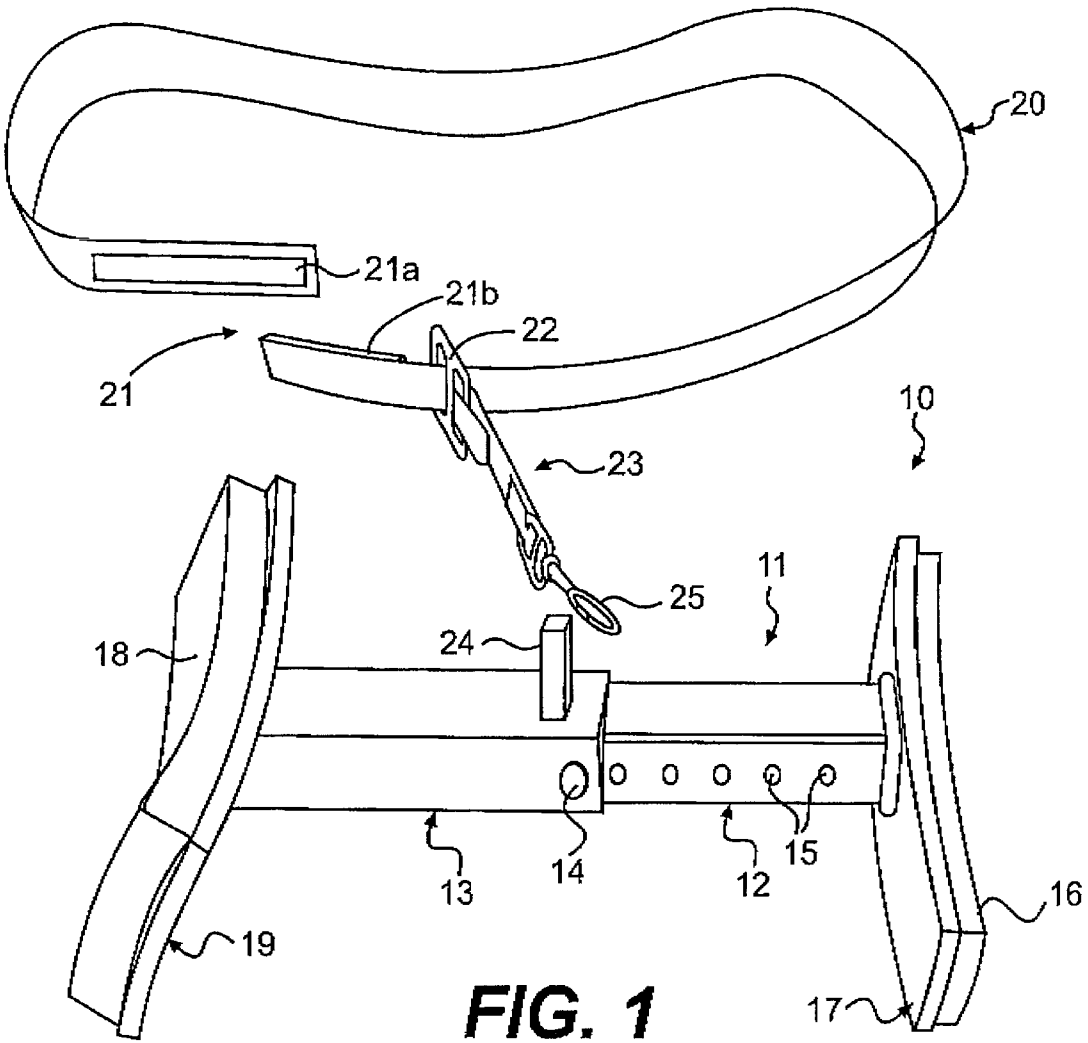
FIG. 1 is a perspective view of one embodiment of the training aid.

Referring to FIG. 1, the training aid 10 has an elongate body 11 (eg., moulded from suitable plastics material) having a first body leg 12 telescopically, not rotatably, engaged within the second body leg 13. A locking pin 14 is releasably engageable in aligned holes 15, (not shown) in the body legs 12, 13 to enable the length of the body 11 to be selectively adjustable.

Figure 2:
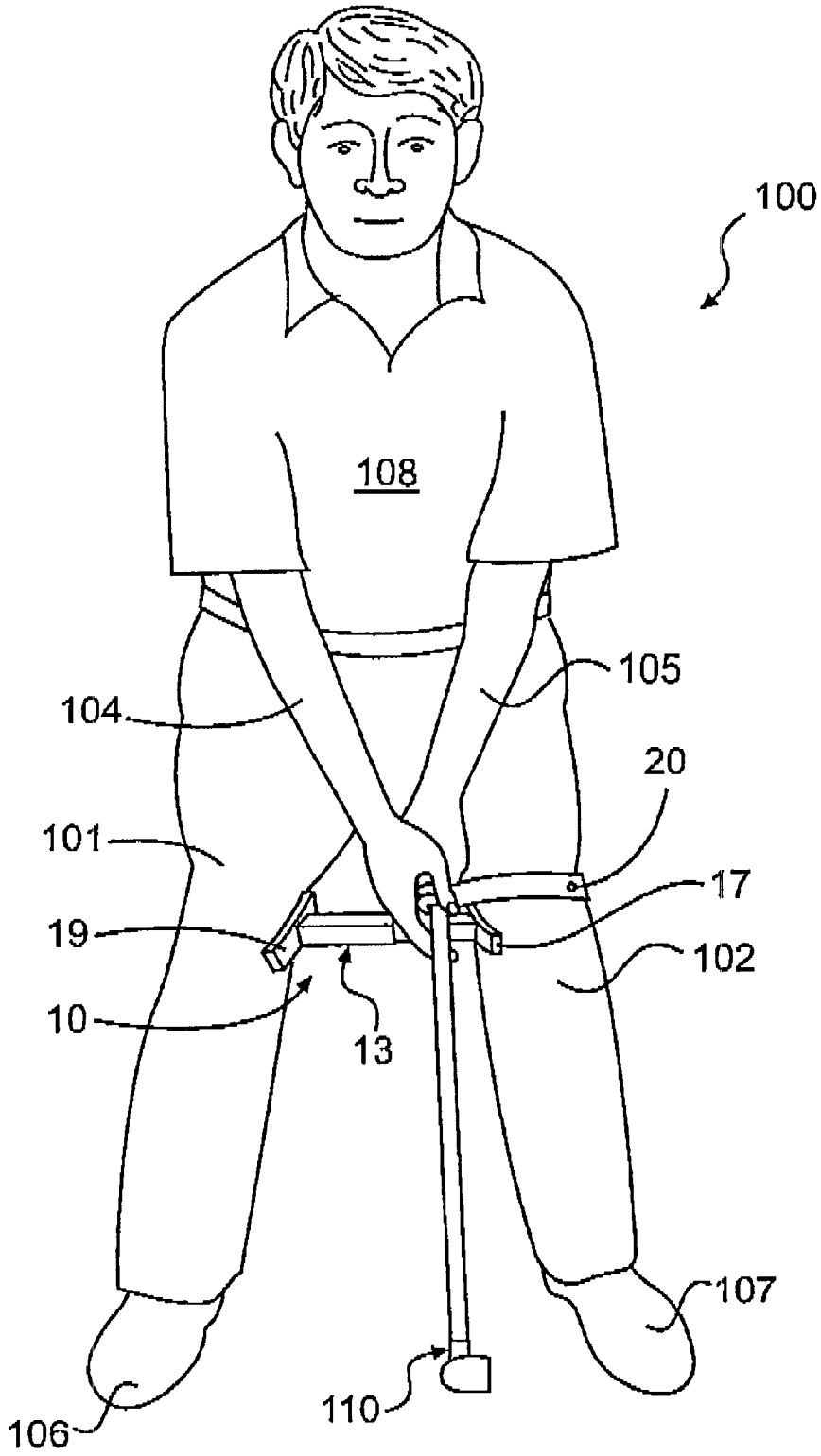
FIG. 2 is a schematic front view showing a right-hand golfer, at his initial stance, with the aid in position.
Figure 3:
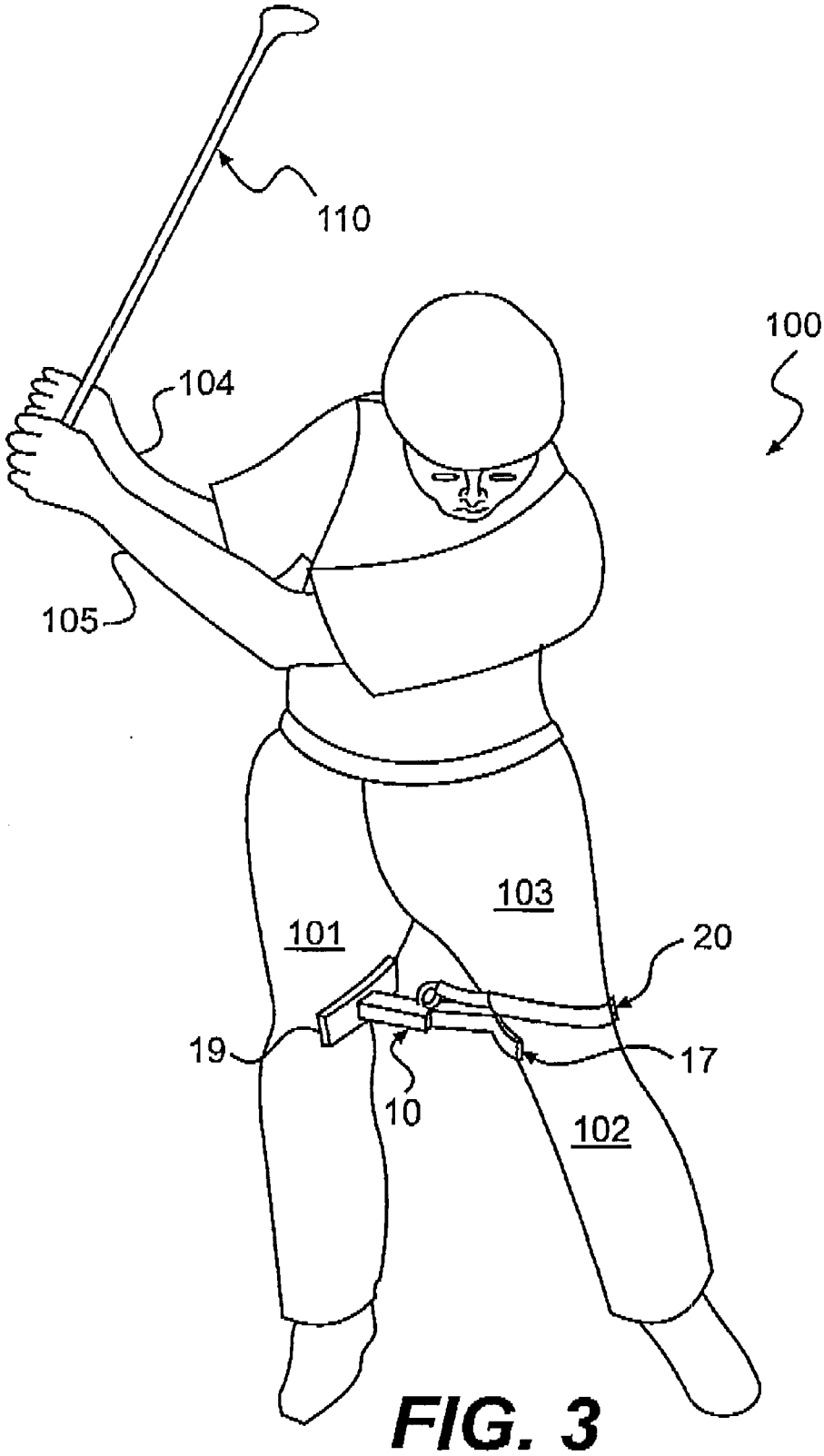
FIG. 3 is a schematic front view showing the golfer at the full back swing position.

A resilient (eg., plastic foam) pad 16 is provided on the outer face of a cross-head 17 on the first leg 12 and, as shown in FIG. 2, is adapted to engage a (right-handed) golfer's left knee just above the knee joint. The pad 16 (and cross-head 17) are of shallow concave shape in top plan view.

A second pad 18, of similar material, is provided on the outer face of a cross-head 19 on the second leg 13. This pad 18 is arranged to releasably engage the (right-handed) golfer's right knee, just above the knee joint, as in FIG. 2. It will be noted that while the pad 18 is also of shallow concave profile in top plan view, it is inclined at an angle (eg., in the range of 10° to 30°) from the normal to the longitudinal axis of the elongate body 11. The pad 18 may incorporate a shallow convex profile in end view, as shown in FIG. 1.

The aid 10 is releasably secured to the player's leg by an elongate strap 20 which may be wrapped around the player's leg and be secured by a releasable fastener 21 incorporating the respective hooks and loop portions 21*a*, 21*b* of "VELCRO" (Registered Trade Mark) material.

The strap 20 passes through a loop 22 at one end of an attachment strap 23, which is attached to a post 24 on the second leg 13 by a releasable buckle 25.

In alternative embodiments, not shown, the strap 20 may be secured about the player's leg by clips, buckles or other suitable releasable fasteners.

In an alternative embodiment not illustrated, the training aid has a box-like body (eg., moulded from suitable plastics material) having a first body component telescopically received within the second body component. A locking pin is receivably engaged in aligned pairs of holes in the body components to enable the length of the body to be selectively adjustable.

The "nose" at the distal end of the first body component is tapered in side view and substantially concave in plan view to releasably engage the left leg of the (right-handed) player at, or just above, the player's left knee. A strap assembly has a loop member releasably securable about the player's left leg. The loop member may be secured by clips, buckles, "Velcro" (Registered Trade Mark) material or like releasable fastening means to enable the training aid to be releasably secured to the player's leg.

The "tail" at the distal end of the second body component is downwardly inclined in side view and concave in plan view and may be provided with cushioning strips. The "tail" is arranged to engage the (right-handed) player's right leg at, or just above, the player's right knee and is configured so that as the player's right knee swings inwardly, when his arms have reached, or pass the centre of gravity of the aid, the forces applied by the knee to the aid will cause the tail of the training aid to move downwardly to be released from the knee.

For a left-handed player, the "nose" will be secured to the is player's right leg and the "tail" will releasably engage the left leg.

Referring now to FIG. 2, the training aid 10 is fitted between the knees 101, 102 of the player 100, just above the respective knee joints. The length of the body 11 of the aid 10 is adjusted for a comfortable stance. The cross-head 17 (and pad 16) on the first leg 12 are secured to the left knee 102 (of a right-handed player) by the strap 20.

As the player 100 makes the backswing of his club 110, the training aid 10 maintains the knees 101, 102, and thereby the lower body 103, substantially stable, as the players arms 104, 105 go through the motion of the backswing.

This places the left upper body side muscles in tension, to act as a spring on the downswing.

Figure 4:
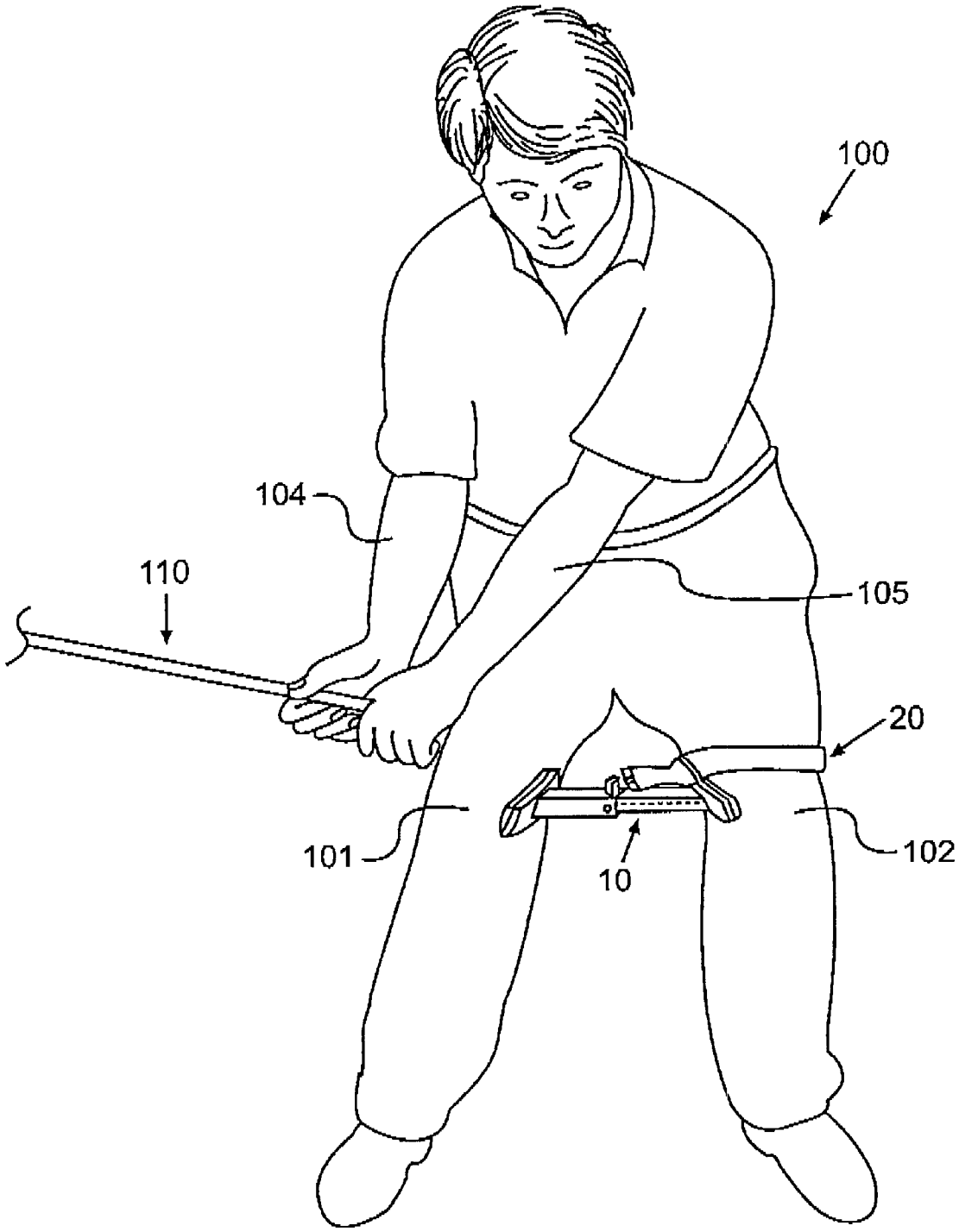
FIG. 4 is a similar view at the mid-downswing position.
Figure 5:
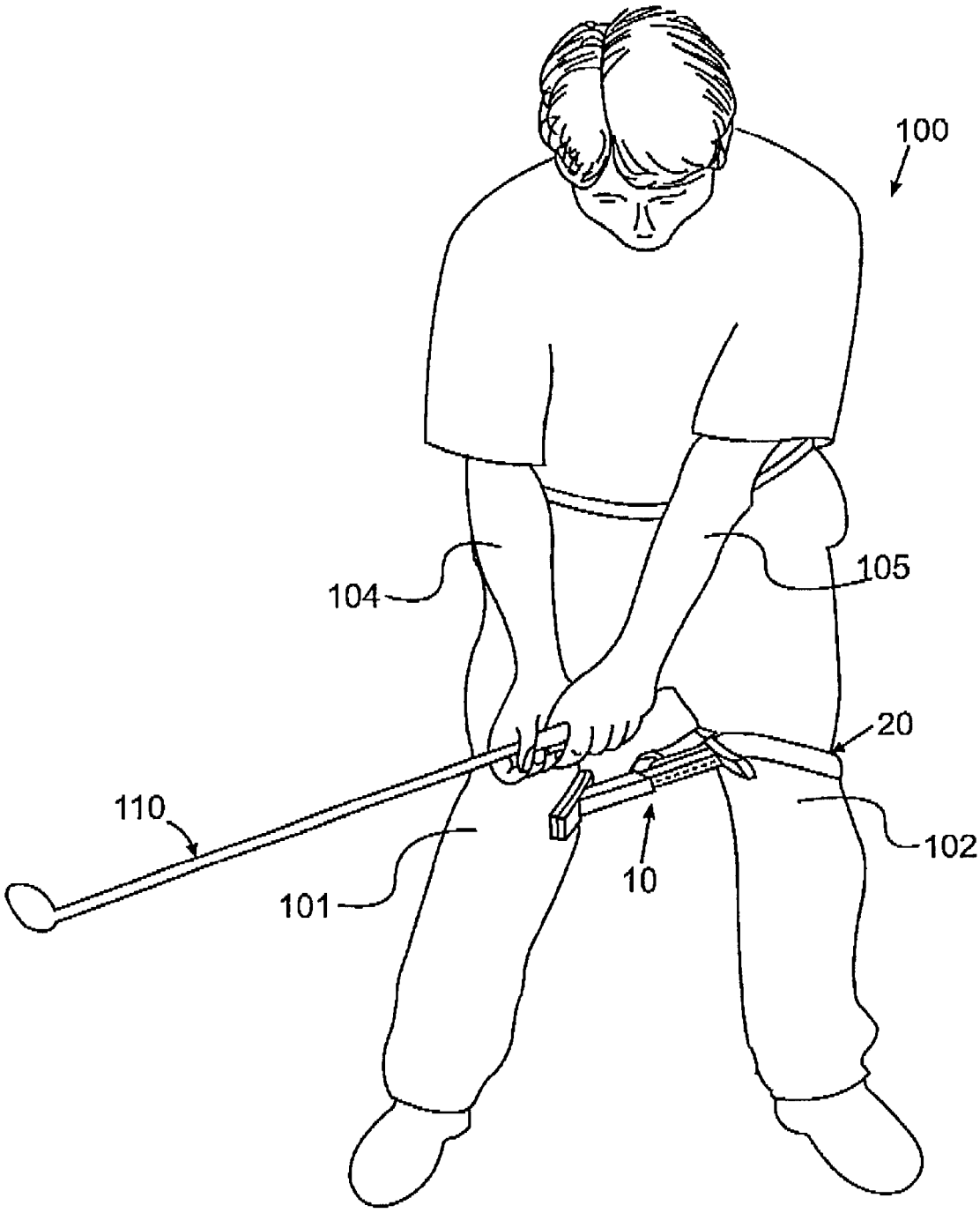
FIGS. 5 and 6 are similar views just before and after (respectively) release of the aid.

On the downswing (see FIGS. 4 and 5), the aid 10 locates the knees 101, 102 to provide correct body control and movement.

Figure 6:
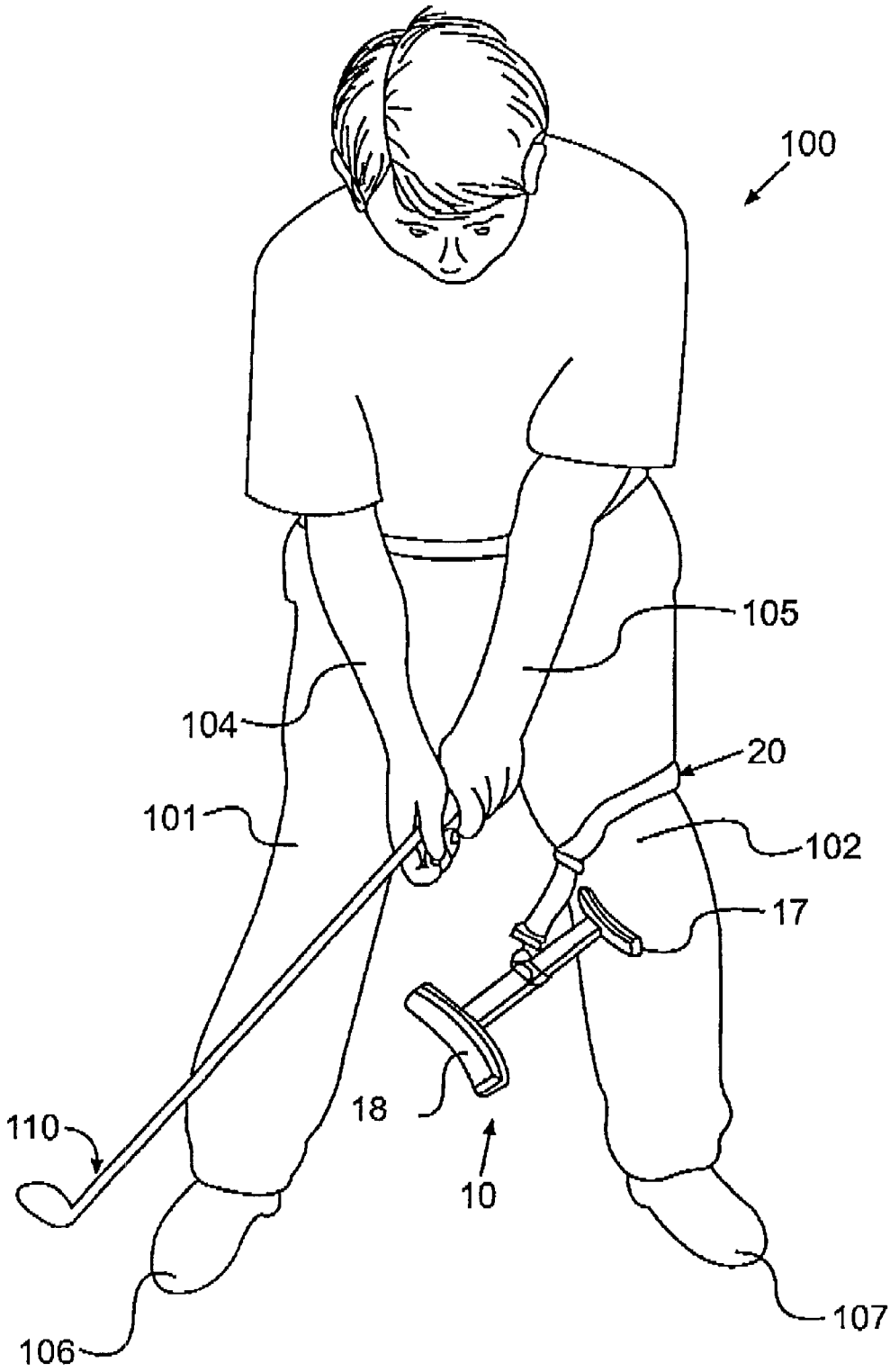

As the golf club 110 approaches, or passes, the player's right foot 106, see FIG. 6, the knees 101, 102 are permitted to move apart to release the cross-head 19 (and pad 18) from the player's right knee 101. The aid 10 drops free, suspended from the left knee 102 by the strap 20.

The actual point in the downswing at which release of the aid 10 from the right knee 101 will occur will be variable but will usually fall in the range of the club 110 closely adjacent to, or passing, the right foot 106 to a point mid-point between the player's feet 106, 107 (ie., adjacent the centre of gravity of the training aid 10).

Figure 7:
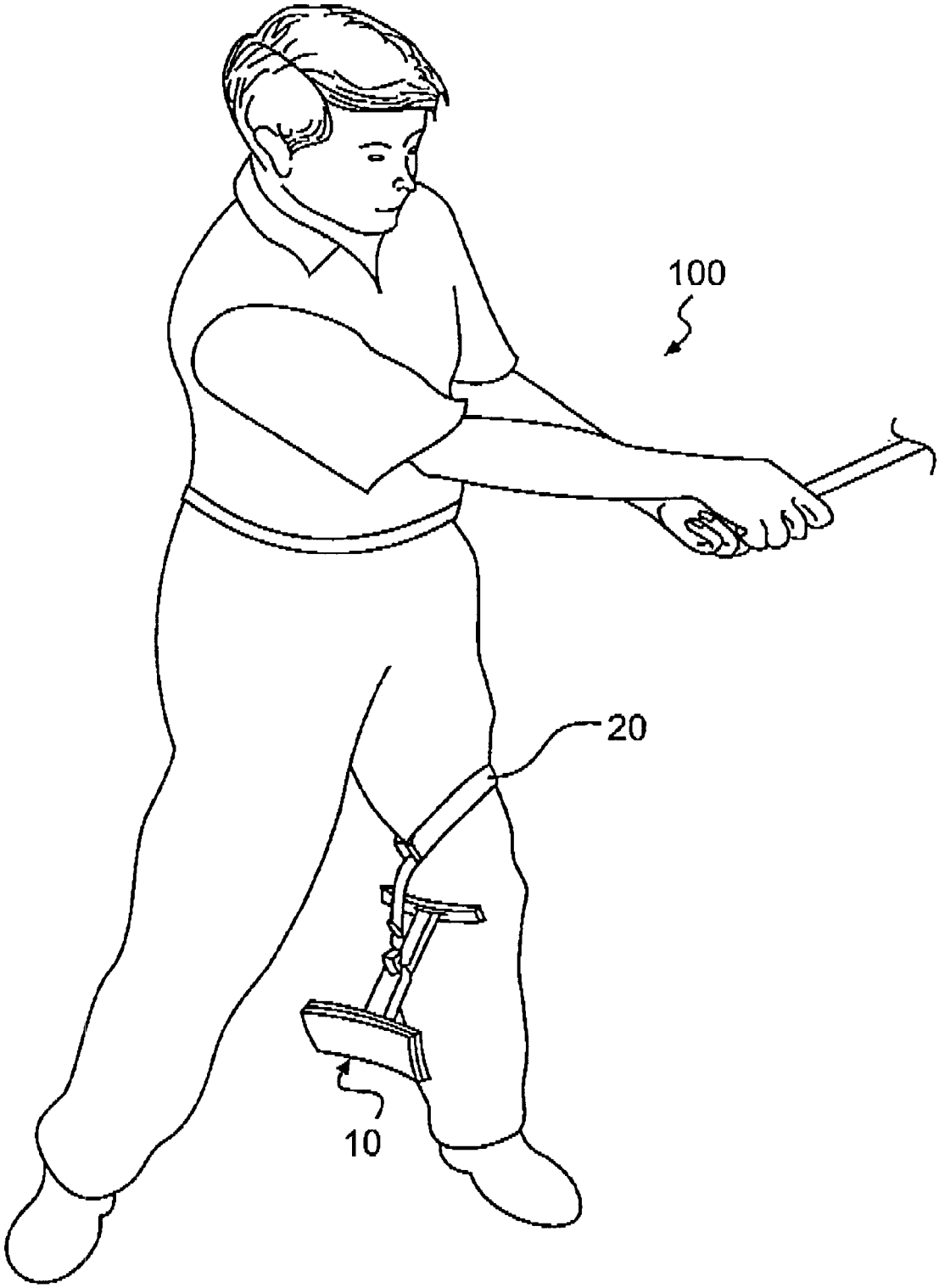
FIG. 7 is a similar views of the golfer at the mid-upswing position.
Figure 8:
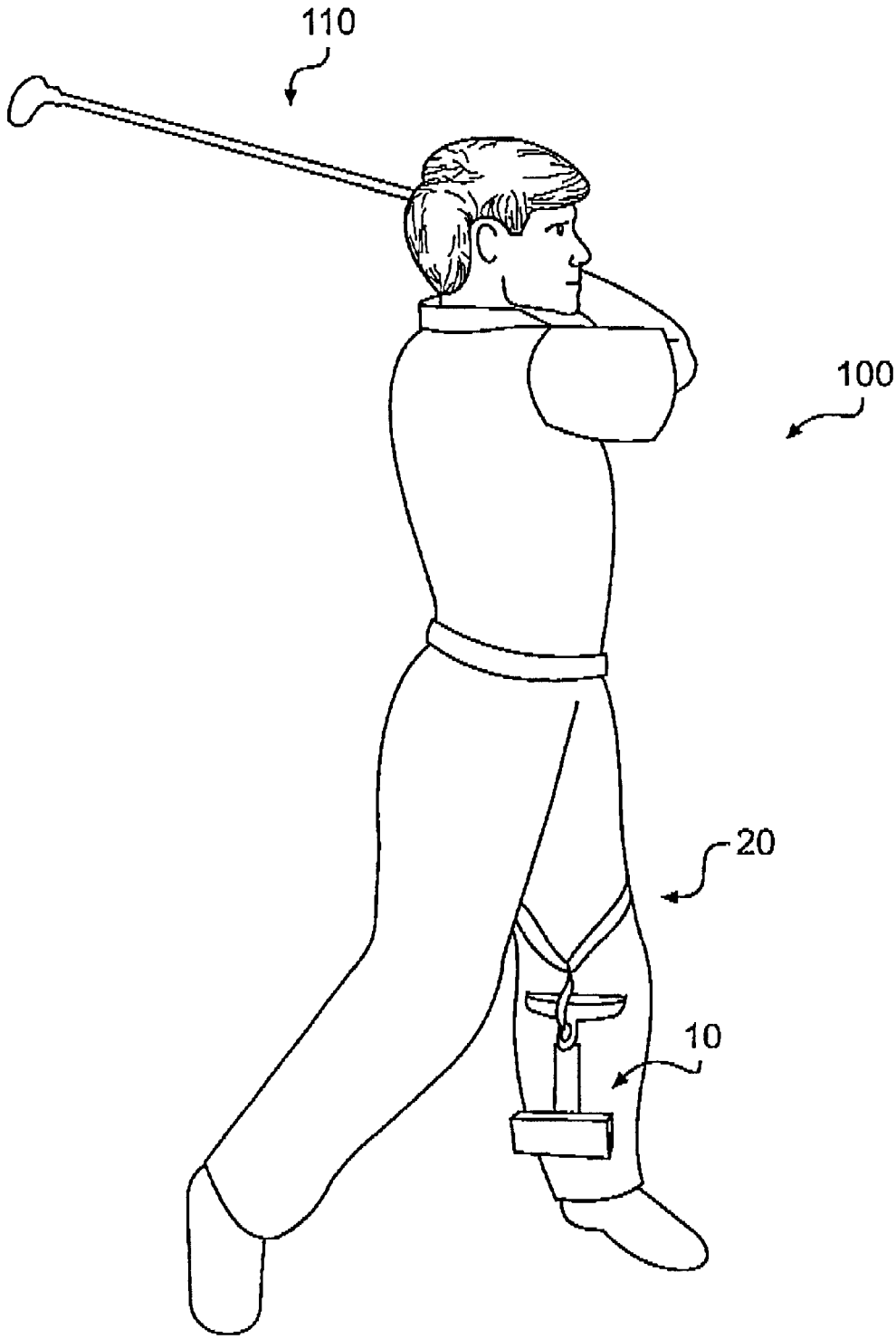
FIG. 8 is a similar view of the golfer at the completion of the stroke.

As shown in FIGS. 7 and 8, the player 100 is then able to complete his swing without interconnection between his knees, resulting in a more natural swing than is possible with the prior art aids hereinbefore discussed.

Figure 9:
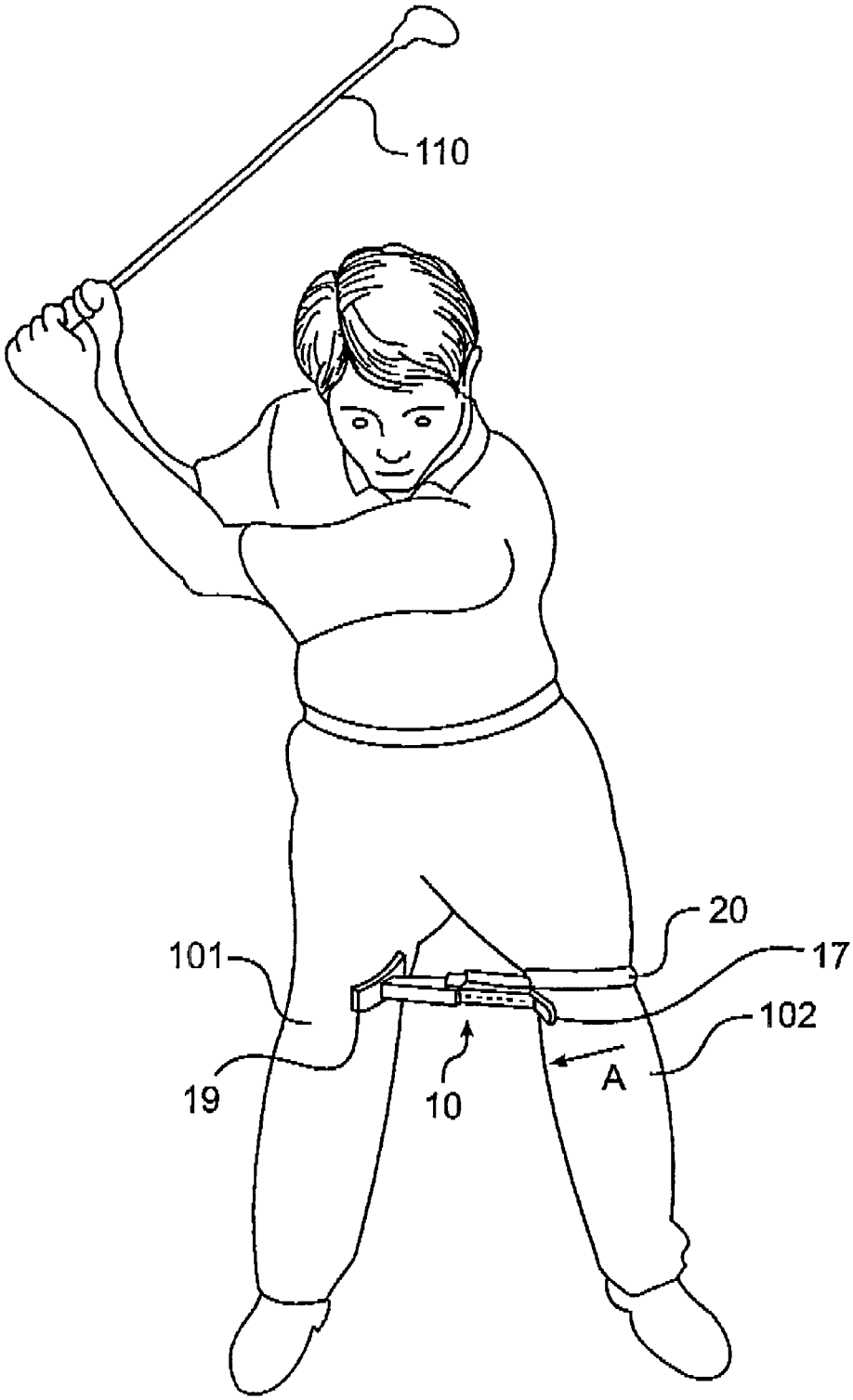
FIG. 9 is a schematic front view of the golfer showing the action of the aid when the golfer's hips sway, on the backswing.
Figure 10:
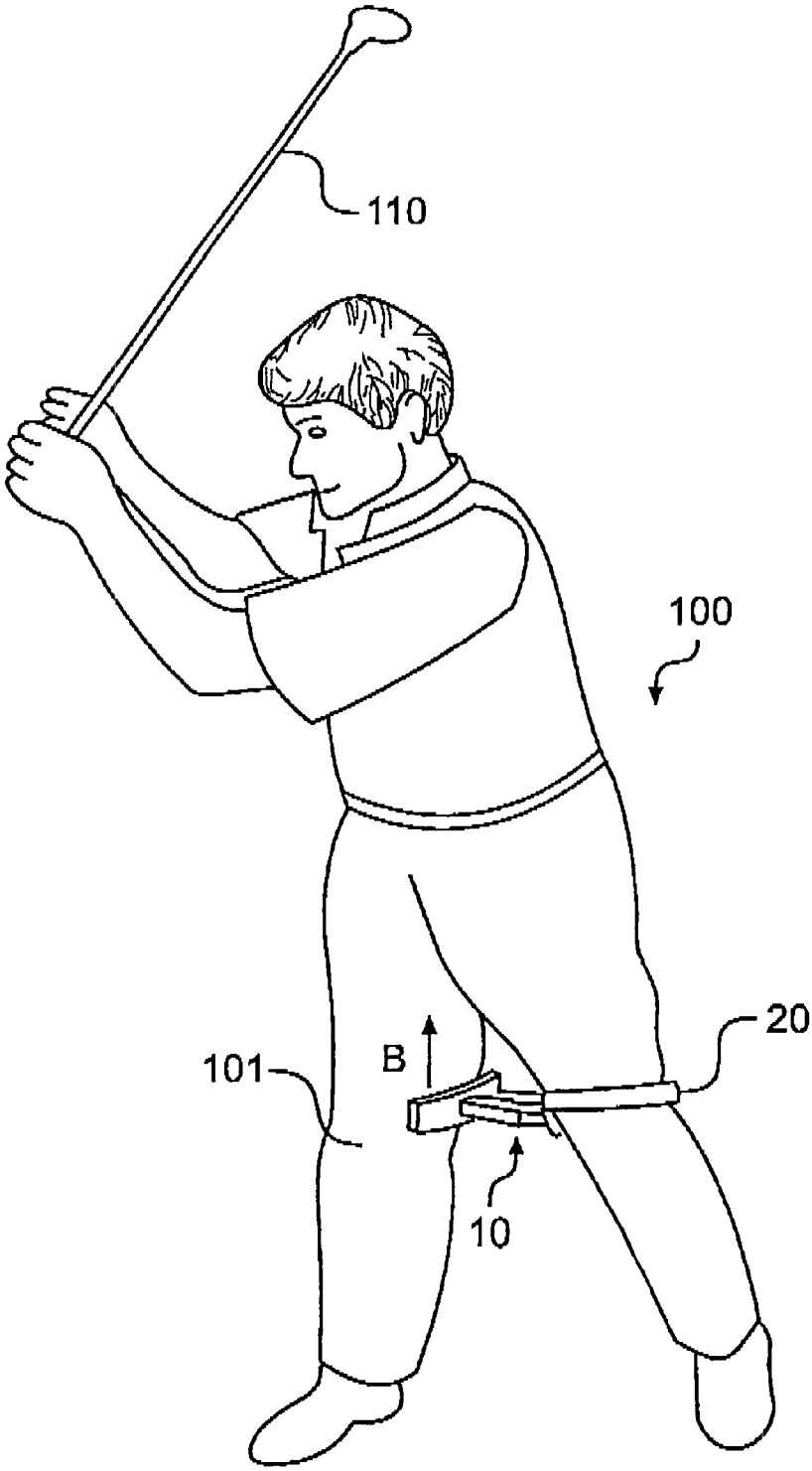
FIG. 10 is a similar view when the golfer's hips have over-rotated on the backswing.
Figure 11:
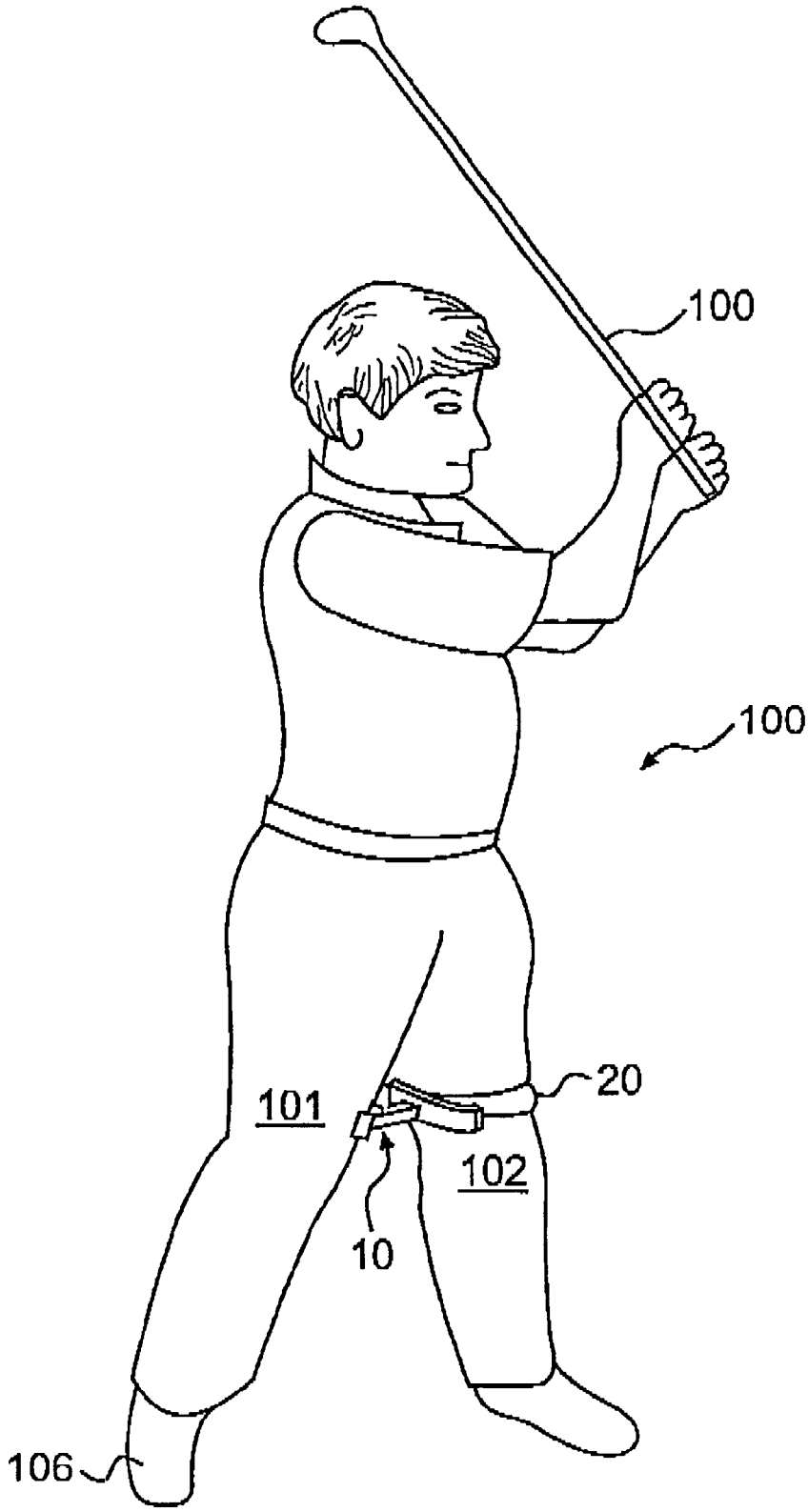
FIG. 11 is a similar view where the hip action has been incorrect on the downswing.

As shown in FIGS. 9 to 11, the training aid 10 can indicate the type of faults in a golfer's swing.

In FIG. 9, where the player's hips have swayed, the training aid 20 becomes locked between the player's knees 101, 102 as the right knee 102 moves in the direction of arrow A.

In over-rotation of the player's hips, see FIG. 10, the training aid 10 becomes locked between the player's legs and cross-head 19 (and pad 18) rides up the right leg, ie., to move in the direction of arrow B above the right knee 101 and be locked between the legs.

In FIG. 11, if the swing is incorrect, the training aid 10 will remain locked between the knees 101, 102 as the downswing is completed.

(In certain instances, errors in the downswing will cause the training aid 10 to be released from the right knee 101 before the golf club 110 reaches the right foot 106.)

In tests carried out by the inventor, it has been established that for golf swings, the training aid 10 maintains the lower body 103 substantially stable during the back swing and approximately the first half 30 of the downswing, the upper body (or torso) 108 being "twisted" like a torsion spring to provide power to the arms 104, 105, and thereby the club 110 (or bat) on the forward swing.

As the training aid releases the player's knees 101, 102 in the second half of the forward swing, the knees are allowed to move, so that portion of the swing remains natural.

As shown in FIGS. 9 to 11, the aid 10 can also indicate the problem(s) with the player's swing.

The aid is easy to fit and can be easily reduced in size for transport or storage. The aid is also relatively inexpensive to manufacture and does not rely on any supplementary equipment.

Various changes and modifications may be made to the embodiments described and illustrated without departing from the present invention.

What is claimed is:

1. A swing training method for golf or other sports, including:

providing an elongate body with respective first and second end portions and a releasable securement means;

arranging said first and second end portions being engaged with a player's legs at, or adjacent, the player's knees and arranging said releasable securement means at or adjacent one of the end portions to releasably secure the body to the adjacent one of the player's legs so that on a back swing and during at least a portion of a forward swing, the player's knees are maintained in a substantially fixed or stable relationship whereby the other end of the body is released from the player's legs to allow the player's knees to move before the completion of the forward swing.

2. A swing training method, as claimed in claim 1 wherein:

the first and second end portions are telescopically interconnected with each other so as to vary the length of the body.

3. A swing training method as claimed in claim 2 wherein:

a releasable lock, clip, bolt, or pawl is provided to enable the length of the body to be selectively set.

4. A swing training method as claimed in claim 2 wherein:

the first and second end portions are a pair of knee-engagement cups or yoke-like members provided at the ends of a pair of telescopically inter-engaged tubes.

5. A swing training method as claimed in claim 1 wherein:

the securement means is a strap, rope, or thong releasably securable about one of the player's legs.

6. A swing training method as claimed in claim 1 wherein:

one of the first and second end portions provides a pivotal axis for the body when the other end portion is released from the player's leg.

7. A swing training method as claimed in claim 6 wherein:

the other end portion has an inclined face, curved in plan view, so arranged that during the completion portion of the swing, the player's corresponding knee will tend to force that end portion of the body downwardly to release the aid from that corresponding knee.

8. A swing training method as claimed in claim 7 wherein:

the inclined face is concave in plan view, convex in end view and inclined at an angle in the range of 10° to 30° to the normal to the longitudinal axis of the body.

9. A swing training method as claimed in claim 1 wherein:

the body will be released from the player's other knee, when the player's arms, on the forward swing, are in advance of or pass, the centre of gravity of the aid.

10. A swing training method as claimed in claim 1 wherein:

for a right-handed golfer or batter, the aid will be secured to the left leg at, or above, the left knee, and the aid will releasably engage at or above the right knee of the player's right leg.

* * * * *